US005458108A

United States Patent [19]

Jacobs

[11] Patent Number: 5,458,108

[45] Date of Patent: Oct. 17, 1995

[54] HAIR COMB

[76] Inventor: Linda J. Jacobs, Rte. 7, Box 158 K, Fayetteville, N.C. 28306

[21] Appl. No.: 303,407

[22] Filed: Sep. 9, 1994

[51] Int. Cl.[6] ..... A45D 8/12; A45D 8/30

[52] U.S. Cl. ..... 132/156; 132/144; 132/273

[58] Field of Search ..... 132/275, 200, 132/273, 107, 156, 144, 157, 146, 148, 108, 219, 248

[56] References Cited

U.S. PATENT DOCUMENTS

| | | | |
|---|---|---|---|
| 581,040 | 4/1897 | Schultz . | |
| 684,066 | 10/1901 | King | 132/144 |
| 756,545 | 4/1904 | Vallendar . | |
| 768,658 | 8/1904 | Dongille | 132/144 |
| 971,519 | 10/1910 | Brannen | 132/156 |
| 1,811,842 | 6/1931 | Bossart | 132/273 |
| 2,302,480 | 11/1942 | Tara . | |
| 2,407,393 | 9/1946 | Behr | 132/273 |
| 2,490,285 | 12/1949 | Smith . | |
| 2,569,659 | 10/1951 | Dombek | 132/107 |
| 2,595,564 | 5/1952 | Budd | 132/107 |
| 2,595,657 | 5/1952 | Harmon | 132/107 |
| 2,596,657 | 5/1952 | Harmon . | |
| 2,792,007 | 5/1957 | Parmer . | |
| 2,805,673 | 9/1957 | Solomon | 132/275 |
| 2,929,386 | 3/1960 | Behr et al. . | |
| 2,948,248 | 5/1961 | Sidelman . | |
| 2,989,058 | 6/1961 | Freyer et al. . | |
| 4,648,414 | 3/1987 | Fox et al. . | |
| 5,156,171 | 10/1992 | Goodman | 132/275 |
| 5,318,054 | 6/1994 | Neilson et al. | 132/275 |

*Primary Examiner*—Paul J. Hirsch
*Attorney, Agent, or Firm*—Rosenthal & Putterman

[57] ABSTRACT

A hair comb for use as a decorative fashion accessory characterized by its ability to grip and retain the hair of the wearer in order to maintain a desired hair style comprises an elongate flexible, bendable, rod-like member of a closed cell foam. A stiffening wire is integral with and extends along substantially the entire length of the rod-like member. Spaced apart plastic teeth are embedded within and extend outwardly from and beyond the exterior surface of the rod-like member. A decorative covering surrounding encases the rod-like member so that the teeth protrude through the covering. An optional closure means is connected to the covering at opposite ends. The wire, teeth, and closure means cooperate to maintain the comb in the desired position in the hair.

16 Claims, 4 Drawing Sheets

HAIR COMB

FIELD OF THE INVENTION

This invention relates generally to the field of personal grooming accessories and more particularly to a hair retaining comb having an enhanced ability to grip the hair and having an outer decorative covering.

BACKGROUND OF THE INVENTION

Hair retaining accessories are well known and are in wide use throughout the world. One such comb is disclosed in U.S. Pat. No. 756,545 to O. Vallendar which teaches an arrangement of the teeth of the comb in such a manner that a gripping action is produced on the bunches of hair contained between the sides of the adjacent teeth when the comb is in use. To attain the desired results, the back or body portion is curved longitudinally and is formed of an elastic or resilient material. The teeth are connected to the back and extend therefrom in such a manner that they are normally at an angle to one another, their points or outer ends being closer together than their inner ends or part which is connected with the back. Such an arrangement results in a separation of the teeth or a movement toward parallelism when the back of the comb is flexed toward a straight line. In the application of the comb to the hair the back is straightened, and the teeth then being substantially parallel freely enter the hair, and when the back is released it by its resilience again assume its normal curved condition, and so cause the points of the teeth to approach one another and close on and grip the hair contained between them.

U.S. Pat. No. 2,984,248 to Sidelman discloses a light weight hair retaining fine tooth metal comb. The comb generally comprises a relatively thin head having a concave arcuate cross-section. A plurality of teeth are integral with the head and depend therefrom. The teeth are substantially parallel to one another and are tapered from the upper end, at the junction with the head of the comb, to a relatively narrow blunt point, at the free end of each tooth. The teeth are provided with a plurality of corrugations of alternately concave and convex arcuate contours in the upper portion thereof. The lower portion of the teeth are straight and the tips are coated in a plastic material. The corrugations are located in an arcuate plane following the arcuate contour of the head of the comb and also the contour of the head of the wearer, thus concealing the teeth of the comb within the hair, while it is being worn, only the relatively shallow head of the comb being exposed. The straight lower portion of the teeth facilitates insertion and the corrugations facilitate gripping of the comb by the hair of the wearer.

U.S. Pat. No. 2,792,007 to D. J. Parmer discloses a flexible comb which can be bent into various shapes. The comb comprises a copper wire, and having a plurality of teeth depending therefrom which together form the framework of the comb. Over this framework is provided a flexible coating of a flexible plastic material such as polyethylene or rubber. The comb thus formed may be bent longitudinally to form a variety of shapes. After being bent laterally or longitudinally into the desired shape, the inherent characteristics of the copper framework maintain the shape of the comb. It can then be inserted into the hair and worn as an ornament.

The foregoing hair retaining devices while effective at maintaining the hair in a desired position, are substantially embedded below the hairline and are intended to remain hidden from view and, therefore, fail to provide any decorative enhancement to the hair style.

Also of note is U.S. Pat. No. 4,648,414 to Fox et al. which discloses a bendable lightweight article for personal grooming. The article comprises an elongate lightweight and readily bendable rod that is adapted to be used for a variety of purposes such as a hair curling rod. The rod comprises a low density and continuous foam body of closed cell foam, a pliable metallic core extends throughout the length of the body and serves to resiliently maintain the body in any desired bent configuration. Adhesive surrounds the metallic core throughout the length thereof and bonds the metallic core to the body so that the body and metallic core are unitized and bend together. The adhesive also serves as a corrosion resistant protective coating on the metallic core. While the just described hair curling is somewhat effective in maintaining the hair in the desired position during styling, it is unsuitable for wear as an article of fashion due to its rather utilitarian and plain appearance. In addition, the article lacks any form of means for actively gripping the hair which renders it largely unsuitable for use during normal everyday activities.

In view of the foregoing, it would therefore be of commercial value to provide a hair retaining apparatus that is also a fashion item and that further assists in maintaining the wearer's hairstyle.

It is therefore an object of the present invention to provide an improved hair comb.

It is another object of the present invention to provide a hair comb that solves the aforementioned problems.

It is a further object of the present invention to provide a hair comb that is decorative and also functional.

It is another object of the present invention to provide a hair comb having improved hair retaining capabilities.

SUMMARY OF THE INVENTION

To accomplish the foregoing objects, there is provided an elongate, flexible, hair comb characterized by its ability to grip and retain the hair of a wearer in order to maintain a desired hair style. The comb comprises an elongate flexible, bendable, rod-like member of a closed cell foamed material. A stiffening wire is integral and extends along substantially the entire length of the rod-like member. A plurality of spaced apart plastic teeth are embedded within and extend outward from and beyond the exterior surface of the rod-like member. A decorative covering is provided that surroundingly encases the member and wherein the teeth protrude through the covering. A closure means is connected to the covering at the opposite ends of the member and when interengaged is adapted to maintain the comb in a looped configuration. The wire, teeth and closure means all cooperate to maintain the comb in the desired configuration about the hair.

BRIEF DESCRIPTION OF THE DRAWINGS

Some of the features and advantages of the invention having been stated, others will appear from the detailed description which follows, when taken in connection with the accompanying drawings in which.

DETAILED DESCRIPTION OF THE ILLUSTRATED EMBODIMENTS

Figure 1:
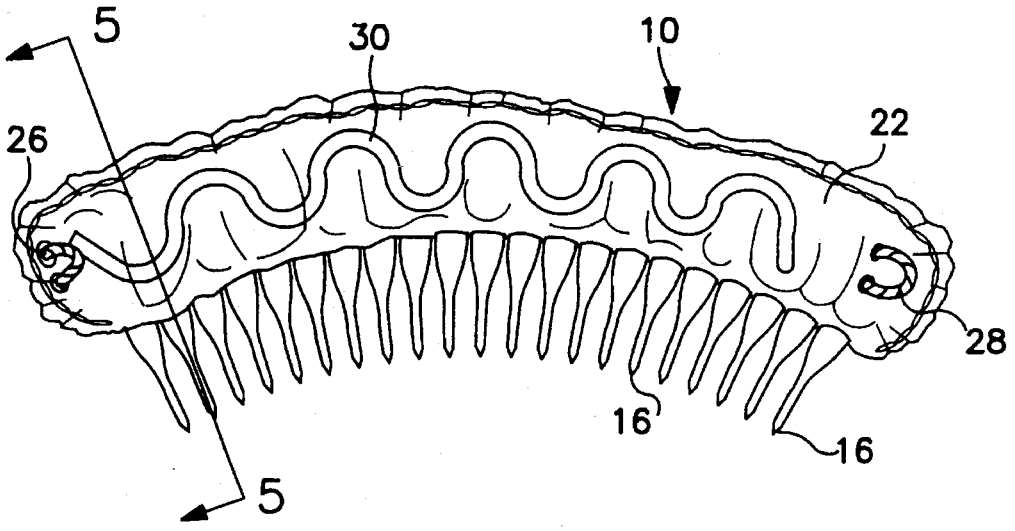
FIG. 1 is a side view of the hair comb according to the present invention.
Figure 2:
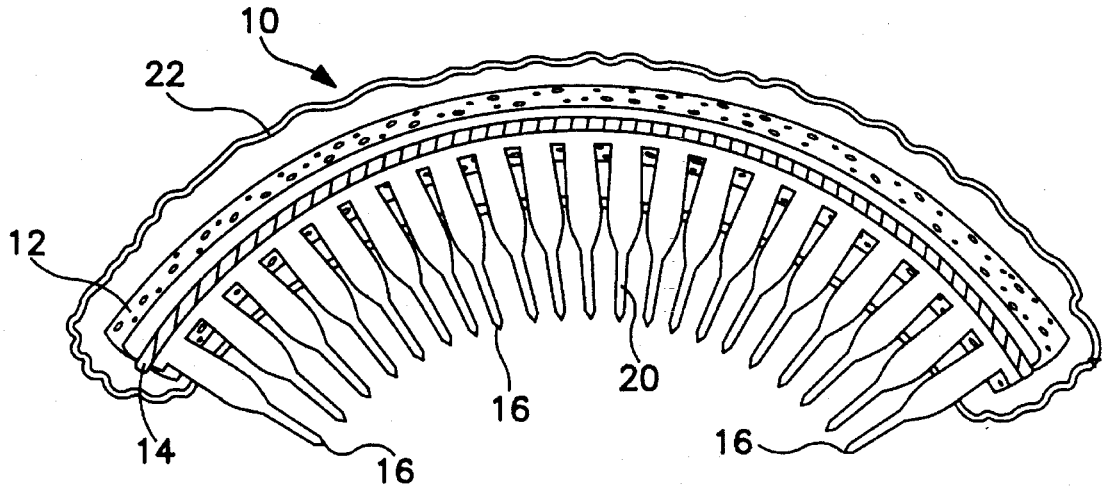
FIG. 2 is a broken away side view of the hair comb according to the present invention.

While the present invention will be described more fully hereinafter with reference to the accompanying drawings, in which particular embodiments are shown, it is to be understood at the outset that persons skilled in the art may modify the invention herein described while still achieving the favorable results of this invention. Accordingly, the description which follows is to be understood as a broad teaching disclosure directed to persons of skill in the appropriate arts and not as limiting upon the present invention.

Referring now specifically to the drawings, the hair comb generally indicated at 10 is there illustrated. The comb 10 comprises an elongate flexible, bendable rod-like member 12 that is generally cylindrical in shape, although no particular cross-section is required. When cylindrical, cross-section of the rod-like member 12 is approximately 0.25 to 1.00 inch in diameter and between about 4 to 10 inches in length with the 6 to 8 inches being typical. The rod-like member is extruded from a closed cell foam such as a polyethylene resin with conventional blowing agents, nucleator, and pigments. An acceptable formulation is disclosed in U.S. Pat. No. 4,648,414 which is incorporated herein.

A stiffening means or wire 14 is integral with and extends along substantially the entire length of the rod-like member 12. In the illustrated embodiments, the wire 14 extends longitudinally along substantially the entire length of the rod-like member along the center thereof. Thus, the wire core is completely surrounded by the foamed body. The wire core is metallic, preferably of a metal which is easily bendable and which is malleable, i.e. it can be easily and repeatedly bent without breaking, such as copper or brass, etc. Alternatively, certain types of plastics may also be employed as the stiffening means. In order to maintain the stiffening means within the foam rod, glue may be employed.

Figure 4:
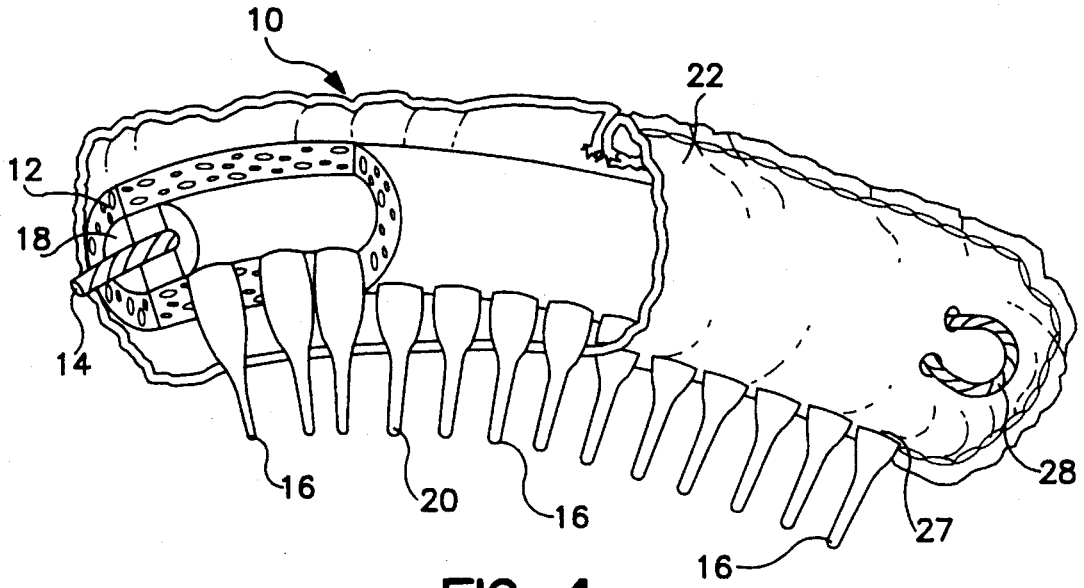
FIG. 4 is a perspective view, partially broken away of the hair comb according to the present invention.
Figure 5:
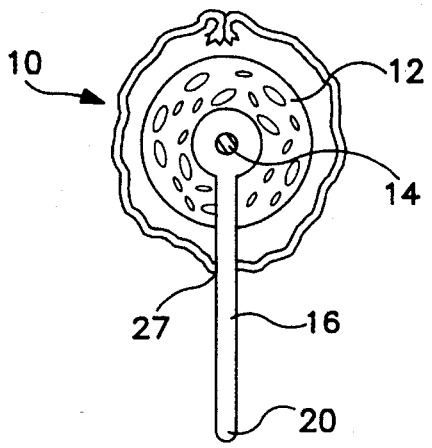
FIG. 5 is an end view taken along line 5—5 of FIG. 1 of the hair comb according to the present invention.
Figure 6:
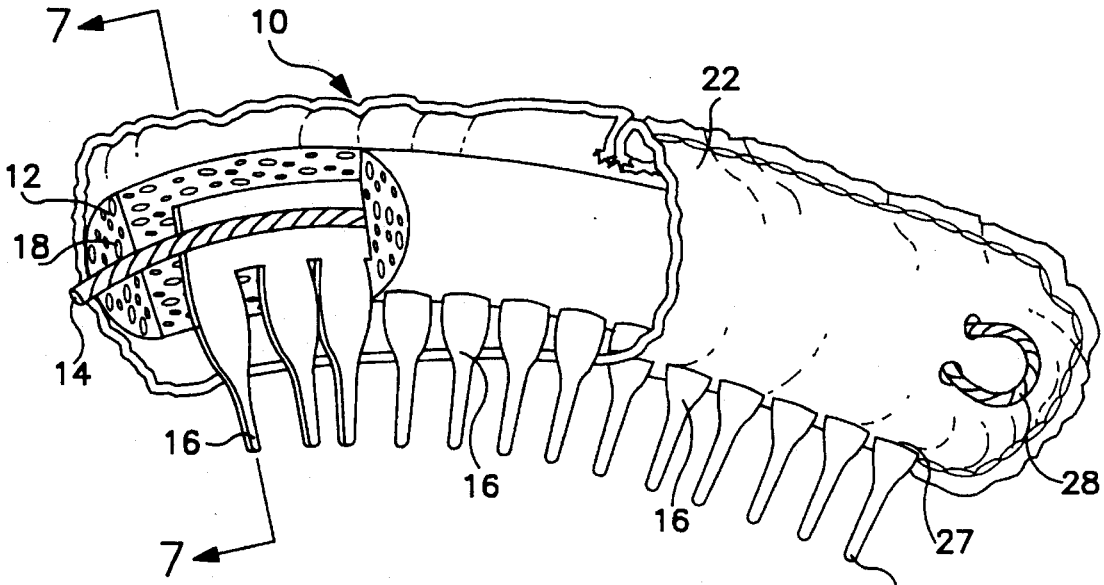
FIG. 6 is a perspective view, partially broken away of a second embodiment of the hair comb according to the present invention.
Figure 7:
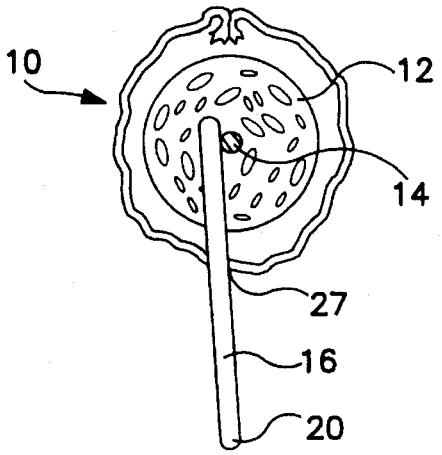
FIG. 7 is an end view taken along line 7—7 of FIG. 6 of a second embodiment the hair comb according to the present invention.

A plurality of spaced apart teeth 16 are supported by and extend outwardly from and beyond the exterior surface of the rod-like member 12. The teeth 16 may be formed of metal or a suitable plastic material. The teeth are wider at the point of attachment to the central core 18 and taper to a rounded point 20. The teeth are fabricated so as to readily deformable when inserted into the hair are slightly compressed. The shape of the teeth combined with the slight outward pressure assist in maintaining the comb in position in the hair. As illustrated in FIG. 4, the teeth 16 may be molded in serial fashion and attached to a central core 18. The foregoing may be molded about the stiffening means 14 using conventional molding techniques well known to those skilled in the art. Alternatively, the central core 18 may also be fabricated to serve as both the support for the teeth 18 and as the stiffening means 14.

A decorative covering 22 surroundingly encases the rod-like member 12. Openings 27 are formed in the cover 22 that permit the teeth 16 to protrude therethrough. In the prototypes that were constructed, the covering was fabricated from a woven fabric such as cotton, polyester or a blend thereof. The cover 22 may be of any fabric and should be able to withstand repeated laundering or dry cleaning.

Figure 3:
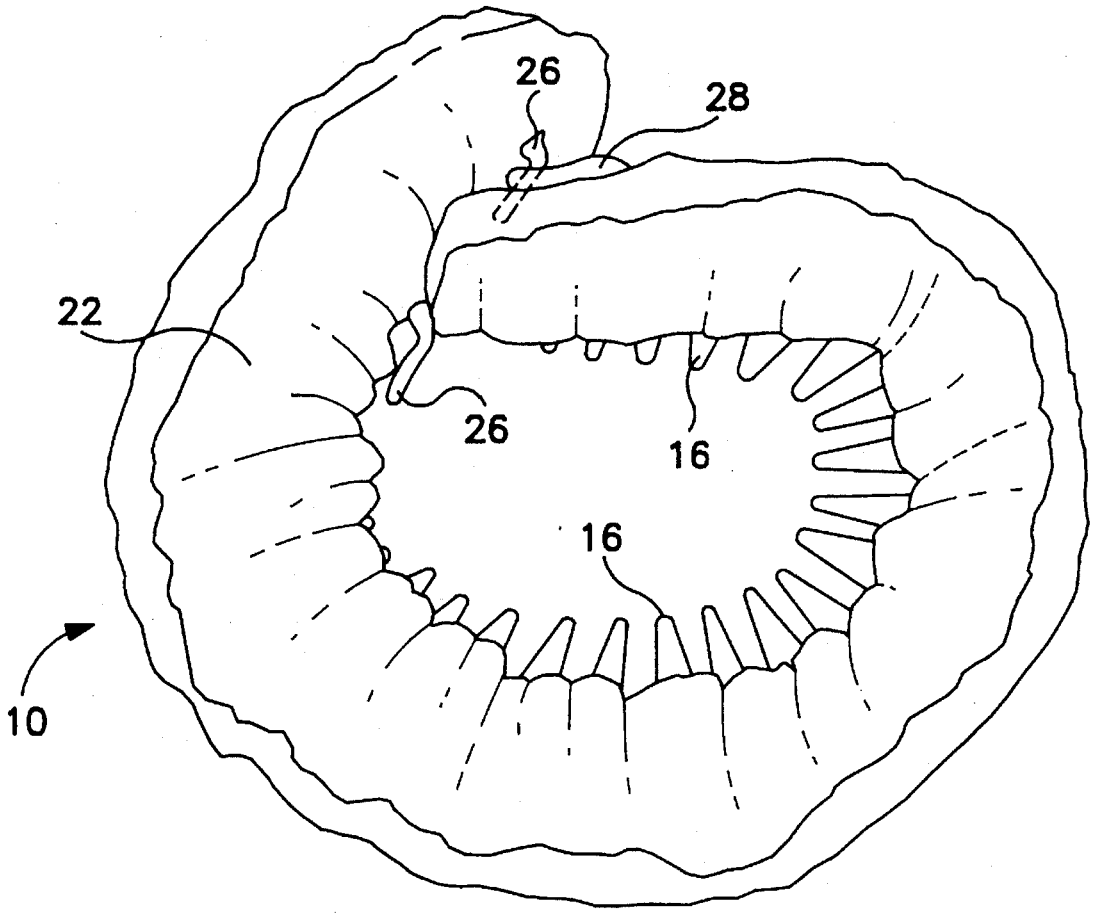
FIG. 3 is a plan view of the hair comb according to the present invention and showing the comb bent into a circle with the opposite ends connected.

A closure means such as a hook and loop fastener system (best illustrated in FIGS. 1 and 3) is provided and assists in maintaining the comb in position about the hair of the wearer. As illustrated in FIG. 3, the closure means takes the form of a hook or hooks 26 connected to the covering at one end and a loop 28 connected to the covering at the opposite end. The comb 10 may be formed into a circle with the hook 26 and loop 28 becoming interconnected to maintain the comb in the circular bent configuration. Alternative closure means may comprise snaps, ties, buckles and the like.

A decorative design 30 may also be applied to the covering 22. One such design is illustrated in FIG. 1 and may be painted thereon, may include rhinestones or colored glues, or any combination of the foregoing may be employed with equal efficacy.

In use, the hair is shaped into the desired style and the comb is inserted therein by applying pressure to the body or core portion of the comb. When it is desired to form the comb into a circle, such as when used in conjunction with a pony tail, the teeth are inserted into the hair and the hook and loop fastener 26, 28 are hooked together as illustrated in FIG. 3. Thus, the wire, teeth and closure means all cooperate to maintain the comb in position in the hair.

The foregoing embodiments are to be considered illustrative rather than restrictive of the invention, and those modifications which come within the meaning and range of equivalence of the claims are to be included therein.

That which is claimed is:

1. An elongate flexible hair comb for use as a styling aid and decorative fashion accessory characterized by its ability to grip and retain the hair of a wearer in order to maintain a desired hair style and comprising:

an elongate flexible, bendable, rod-like member of a foamed material, a stiffening means integral with and extending along substantially the entire length of said rod-like member;

a plurality of spaced apart teeth supported by and extending outwardly from and beyond the exterior surface of said rod-like member, and wherein said rod-like member, said stiffening means and said teeth all cooperate to maintain said comb in place within the wearer's hair when said comb is placed therein, whereby the comb remains firmly in place in the wearer's head.

2. The hair gripping comb according to claim 1 further including a covering surroundingly encasing said rod-like member and wherein said teeth protrude through said covering.

3. The hair gripping comb according to claim 2 further including closure means connected to said covering at the opposite ends of said rod-like member and being adapted to interconnect in order to maintain said comb in a bent configuration.

4. The hair gripping comb according to claim 3 further including a decorative design applied to said decorative covering.

5. The hair gripping comb according to claim 2 wherein said covering comprises a fabric.

6. The hair gripping comb according to claim 1 wherein said stiffening means comprises an elongate, flexible, bendable wire disposed in contacting relation with said foamed rod-like member.

7. The hair gripping comb according to claim 6 wherein said wire is embedded within said rod-like member.

8. The hair gripping comb according to claim 1 wherein said rod-like member comprises an elongate cylinder.

9. An elongate flexible hair comb characterized by its ability to grip and retain the hair of a wearer for use as a styling aid and decorative fashion accessory in order to maintain a desired hair style and comprising:

an elongate, flexible, bendable, rod-like member of a closed cell foamed material;

a stiffening means embedded within said rod-like member and extending along the longitudinal axis thereof;

a plurality of spaced apart hair gripping teeth supported by and extending outwardly from and beyond the exterior surface of said rod-like member, and wherein said rod-like member, said stiffening wire and said teeth all cooperate to maintain said comb in place within the wearer's hair when said comb is placed therein;

whereby the comb remains firmly in place in the wearer's hair.

10. The hair gripping comb according to claim 9 wherein said teeth and said stiffening means are interconnected.

11. The hair gripping comb according to claim 10 wherein said teeth and said stiffening means comprise a unitary piece of metal.

12. The hair gripping comb according to claim 10 wherein said teeth and said stiffening means comprise a unitary piece of plastic.

13. The hair gripping comb according to claim 9 further including a covering surroundingly encasing said rod-like member and wherein said teeth protrude through said covering.

14. The hair gripping comb according to claim 13 further including a closure means connected to said covering at the opposite ends of said rod-like member and being adapted to interconnect in order to maintain the comb in a bent configuration around the wearer's hair.

15. An elongate, flexible hair comb for use as a decorative fashion accessory characterized by its ability to grip and retain the hair of a wearer in order to maintain a desired hair style and comprising:

an elongate, flexible, bendable, rod-like member of a closed cell foamed material, a stiffening wire integral with and extending along substantially the entire length of said rod-like member, a plurality of spaced apart plastic teeth embedded within and extending outwardly from and beyond the exterior surface of said rod-like member, a decorative covering surroundingly encasing said rod-like member and wherein said teeth protrude through said covering, a closure means connected to said covering at the opposite ends of said rod-like member and being adapted to interconnect, and wherein said wire, said teeth and said closure means cooperate to maintain the comb in the desired configuration about the hair.

16. The comb according to claim 15 wherein said closure means is selected from the group consisting of hook and loop fasteners, snaps, ties, and buckles.

* * * * *